US011112711B2

(12) United States Patent
Ochi et al.

(10) Patent No.: US 11,112,711 B2
(45) Date of Patent: Sep. 7, 2021

(54) WHITE TONER

(71) Applicant: CANON KABUSHIKI KAISHA, Tokyo (JP)

(72) Inventors: Kouichirou Ochi, Chiba (JP); Yuya Chimoto, Funabashi (JP); Tomoyo Miyakai, Tokyo (JP); Takashi Hirasa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/923,518

(22) Filed: Jul. 8, 2020

(65) Prior Publication Data

US 2020/0341396 A1 Oct. 29, 2020

Related U.S. Application Data

(63) Continuation of application No. PCT/JP2019/000132, filed on Jan. 8, 2019.

(30) Foreign Application Priority Data

Jan. 10, 2018 (JP) ..... JP2018-001860

(51) Int. Cl.
*G03G 9/09* (2006.01)
*G03G 9/087* (2006.01)

(52) U.S. Cl.
CPC ..... *G03G 9/08755* (2013.01); *G03G 9/0902* (2013.01); *G03G 9/0926* (2013.01)

(58) Field of Classification Search
CPC ..... G03G 9/08795; G03G 9/08797; G03G 9/0902
See application file for complete search history.

(56) References Cited

U.S. PATENT DOCUMENTS

| | | | | |
|---|---|---|---|---|
| 8,293,440 | B2 | 10/2012 | Nakamura et al. | |
| 8,916,321 | B2 | 12/2014 | Kawakami et al. | |
| 9,213,249 | B2 | 12/2015 | Kadonome et al. | |
| 2011/0159422 | A1 | 6/2011 | Nakamura et al. | |
| 2014/0287352 | A1 | 9/2014 | Kawakami et al. | |
| 2014/0349228 | A1 | 11/2014 | Kadonome et al. | |
| 2017/0329247 | A1 * | 11/2017 | Murasawa ..... | G03G 9/1131 |

FOREIGN PATENT DOCUMENTS

| | | | |
|---|---|---|---|
| JP | 2000-56514 | A | 2/2000 |
| JP | 2011-133804 | A | 7/2011 |
| JP | 2011-158769 | A | 8/2011 |
| JP | 2012-173322 | A | 9/2012 |
| JP | 2014-186050 | A | 10/2014 |
| JP | 2014-228763 | A | 12/2014 |

* cited by examiner

*Primary Examiner* — Peter L Vajda
(74) *Attorney, Agent, or Firm* — Venable LLP

(57) ABSTRACT

A white toner comprising a toner particle wherein the toner particle includes a binder resin and a calcium titanate particle, the binder resin has an acid value, and a content of the calcium titanate particle in the toner is in the range of from 25 mass % to 80 mass %.

8 Claims, No Drawings

WHITE TONER

CROSS-REFERENCE TO RELATED APPLICATIONS

This application is a Continuation of International Patent Application No. PCT/JP2019/000132, filed Jan. 8, 2019, which claims the benefits of Japanese Patent Application No. 2018-001860, filed Jan. 10, 2018, both of which are hereby incorporated by reference herein in their entirety.

BACKGROUND OF THE INVENTION

Field of the Invention

The present invention relates to a white toner for use in an electrophotographic image forming method.

Background Art

In recent years, with the development of image forming apparatuses such as copiers and printers, a demand has been created for toners adaptable to various media. Among them, a technique for obtaining a high value-added printed matter using a special color toner such as a transparent toner or a white toner has been developed.

White toner is important for forming white images on colored paper and transparent films, and toners using materials such as titanium oxide having high refractive indices, for example, having been developed for achieving strong concealing properties (PTL 1).

However, such special color toners also need to satisfy greater and greater demands for high speeds and image quality, longer life spans and energy savings. Hot offset resistance is particularly important for securing a fixing temperature range, and for example a technique of crosslinking the binder resin composition of the toner has been proposed as a means for improving hot offset resistance (PTL 2).

CITATION LIST

Patent Literature

PTL 1 Japanese Patent Application Publication 2000-56514

PTL 2 Japanese Patent Application Publication 2012-173322

Usually, in order to form a white image using a white toner and express a sufficient white color, it is preferable to conceal the underlying color and make it unrecognizable. Since such an image concealing property is manifested by the scattering of light in the image film, a colorless pigment with a large difference in refractive index with a binder resin, that is, a material having a high refractive index, is needed. Further, in order to exhibit sufficient concealing property, it is preferable that the above-mentioned white pigment be contained in the toner of a white toner in a larger amount and with better dispersibility than other colors.

It has been found that when a large amount of a white pigment such as titanium oxide is contained in the toner as in PTL 1, the hot offset resistance of the toner during fixing at high temperatures declines because the relative amount of the binder resin is small in comparison with other color toners.

The toner viscosity can also be increased by crosslinking the binder resin composition of the toner as proposed in PTL 2. However, it has been found that in this case the dispersibility of the white pigment declines, and the image concealing properties are reduced.

It is an object of the present invention to solve these problems. That is, the object is to provide a white toner that has excellent concealing properties without a reduction in hot offset resistance.

SUMMARY OF THE INVENTION

The inventors discovered as a result of earnest research that concealing properties and hot offset resistance could both be achieved by using a white toner containing a calcium titanate particle together with a binder resin having an acid value.

That is, the present invention relates to a white toner comprising a toner particle wherein the toner particle includes a binder resin and a calcium titanate particle, the binder resin has an acid value, and a content of the calcium titanate particle in the toner is in the range of from 25 mass % to 80 mass %.

Further features of the present invention will become apparent from the following description of exemplary embodiments.

DESCRIPTION OF THE EMBODIMENTS

In the present invention, unless otherwise specified descriptions of numerical ranges such as "at least X and not more than Y" or "from X to Y" include the numbers at the upper and lower limits of the range.

The toner of the present invention is white toner comprising a toner particle wherein the toner particle includes a binder resin and a calcium titanate particle, the binder resin has an acid value, and a content of the calcium titanate particle in the toner is in the range of from 25 mass % to 80 mass %.

By combining a calcium titanate particle with a binder resin having an acid value in the toner particle, it is possible to achieve both hot offset resistance and concealing properties during image formation.

The reason why calcium titanate has such a particular effect is thought to be as follows. Calcium titanate can normally assume a perovskite crystal structure. Gas molecules and the like are adsorbed onto calcium atoms on the particle surface of the crystals, so sites having hydroxyl groups are present. When these sites are in the presence of a binder resin having carboxyl groups, they can behave as adsorption sites for the carboxyl groups.

Since the calcium titanate particles and binder resin form morphologies resembling crosslinked structures via these adsorption sites, the viscosity of the toner particle during fixing is increased, and hot offset resistance is improved. Such an effect is specific to calcium titanate, and it is thought that the carboxyl group adsorption efficiency is improved due to the coordination state of calcium in the perovskite crystal structure and the specific ionic radius of calcium and the like.

Because this method does not increase the viscosity of the binder resin itself, moreover, the dispersibility of the calcium titanate particle can be increased, and the concealing properties of the white toner are not adversely affected even after image formation.

To confirm whether or not the calcium titanate particle has a perovskite crystal structure, the peak pattern can be analyzed by X-ray diffraction methods.

The binder resin used in the present invention is a binder resin having an acid value. Without an acid value, hot offset resistance is not improved because there are no sites for interaction with the calcium titanate particle.

The acid value of the binder resin is preferably in the range of from 5 mgKOH/g to 40 mgKOH/g, or more preferably in the range of from 10 mg KOH/g to 30 mg KOH/g, or still more preferably in the range of from 12 mg KOH/g to 25 mg KOH/g. If the binder resin has an acid value of at least 5 mg KOH/g, it can interact easily with the calcium titanate, making it easy to improve hot offset resistance. If it is not more than 40 mg KOH/g, the toner has good charging performance.

The weight-average molecular weight of the tetrahydrofuran (THF)-soluble matter of the binder resin as measured by gel permeation chromatography (GPC) is preferably in the range of from 50000 to 200000, or more preferably in the range of from 100000 to 170000. If it is at least 50000, crosslinked structures are formed with the calcium titanate particle, and hot offset resistance is easily improved. If it is not more than 200000, on the other hand, the dispersibility of the calcium titanate particle in the binder resin is improved, and the concealing properties are good.

In the molecular weight distribution of the tetrahydrofuran-soluble matter of the binder resin as measured by GPC, the content of components with a molecular weight of from 100 to 5000 is preferably in the range of from 20 mass % to 40 mass %, or more preferably in the range of from 23 mass % to 35 mass % based on the total mass of the tetrahydrofuran-soluble matter of the binder resin.

When the binder resin contains a certain amount of such low-molecular-weight components, highly mobile components in the binder resin are effectively adsorbed onto the surface of the calcium titanate particle, and hot offset resistance is improved. The content of components with a molecular weight of from 100 to 5000 can be controlled by mixing in a resin having many low-molecular-weight components with molecular weights of from 100 to 5000 as needed.

A known polymer may be used as the binder resin for the toner, and specifically the following polymers may be used.

Homopolymers of styrene and substituted forms thereof such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate ester copolymers, styrene-methacrylate ester copolymer, styrene-α-chloromethyl methacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural resin-modified phenol resin, natural resin-modified maleic acid resin, acrylic resin, methacrylic resin, polyvinyl acetate, silicone resin, polyester resin, polyurethane resin, polyamide resin, furan resin, epoxy resin, xylene resin, polyvinylbutyral, terpene resin, coumarone-indene resin and petroleum-based resin. One kind of binder resin may be used alone, or multiple kinds may be combined.

Of the above, the binder resin preferably contains a polyester resin, and more preferably is a polyester resin. Including a polyester resin makes it easier to disperse the calcium titanate particle, and easier to obtain both hot offset resistance and concealing properties as discussed above. The content of the polyester resin in the binder resin is preferably in the range of from 50 mass % to 100 mass %, or more preferably in the range of from 85 mass % to 100 mass %, or still more preferably in the range of from 95 mass % to 100 mass %.

The polyester resin is preferably a condensation polymer of an alcohol component and an acid component. The following compounds are examples of monomers for forming the polyester resin.

Examples of the alcohol component include the following divalent alcohol.

Ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols represented by the following formula (I) and derivatives thereof, and diols represented by the following formula (II).

Trivalent or higher polyvalent alcohols such as 1,2,3-propanetriol, trimethylolpropane, hexanetriol, and pentaerythritol may also be used as the alcohol component.

(I)

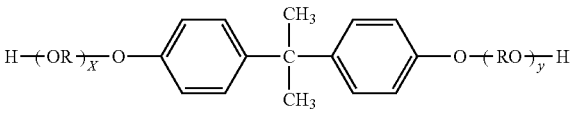

In the formula, R represents an ethylene group or a propylene group, X and Y are each an integer of 0 or more, and the average value of X+Y is from 0 to 10.

(II)

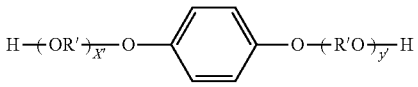

In the formula, R' represents:

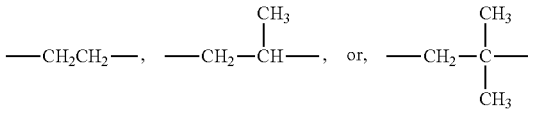

x' and y' are each an integer of 0 or more, and the average value of x'+y' is from 0 to 10.

As the alcohol component, a bisphenol represented by the formula (I) is preferable, and alkylene oxide adducts of bisphenol A, such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene (2.0)-2,2-bis(4-hydroxyphenyl)propane, and polyoxypropylene(6)-2,2-bis(4-hydroxyphenyl)propane are more preferable.

Examples of the acid component include the following divalent carboxylic acids.

Benzenedicarboxylic acids or anhydrides thereof such as phthalic acid, terephthalic acid, isophthalic acid, and phthalic anhydride; alkyl dicarboxylic acids such as succinic acid, adipic acid, sebacic acid, and azelaic acid or anhydrides thereof; succinic acid or an anhydride thereof substituted with an alkyl group having from 6 to 18 carbon atoms or an alkenyl group having from 6 to 18 carbon atoms; and unsaturated dicarboxylic acids such as fumaric acid, maleic acid, citraconic acid, and itaconic acid, or anhydrides thereof.

It is also preferable to use a trivalent or higher polyvalent acid for the acid component. Examples thereof include 1,2,4-benzenetricarboxylic acid (trimellitic acid), 1,2,4-cyclohexanetricarboxylic acid, 1,2,4-naphthalenetricarboxylic acid, pyromellitic acid and acid anhydrides or lower alkyl esters thereof.

Of the above, an aromatic compound that is also highly stable with respect to environmental changes is preferred, and examples include 1,2,4-benzenetricarboxylic acid and its hydride.

The toner particle contains a calcium titanate particle. The content of the calcium titanate particle in the toner is in the range of from 25 mass % to 80 mass %.

If the content is less than 25 mass %, the concealing properties are insufficient, while if it exceeds 80 mass %, the charging performance declines. The content of the calcium titanate particle in the toner is preferably in the range of from 40 mass % to 70 mass %.

The surface base amount of the calcium titanate particle is preferably at least 10 μmol/g. If the surface base amount is at least 10 μmol/g, hot offset resistance is easily improved because the amount of hydroxyl groups is suitable for interaction with the carboxyl groups of the binder resin.

The surface base amount is more preferably at least 15 μmol/g, or still more preferably at least 20 μmol/g. There is no particular upper limit, but preferably it is not more than 200 μmol/g, or still more preferably not more than 150 μmol/g, or especially not more than 40 μmol/g. The surface base amount of the calcium titanate particle can be controlled by surface treatment with various organic materials or inorganic materials, or by crushing the particle to change its surface area and the like.

The average dispersion diameter of the calcium titanate particle in the toner particle is preferably in the range of from 200 nm to 500 nm, or more preferably in the range of from 300 nm to 480 nm. If the average dispersion diameter is within this range, good concealing properties are obtained. When preparing a toner by a pulverization method for example, the average dispersion diameter of the calcium titanate particle in the toner particle can be controlled by changing the shear rate and the like during melt kneading with the resin.

Preferred embodiments of the invention are described in detail below.

<Release Agent (Wax)>

A wax may also be used in the toner. Examples of the wax include the following:

hydrocarbon waxes such as low-molecular-weight polyethylene, low-molecular-weight polypropylene, alkylene copolymers, microcrystalline wax, paraffin wax and Fischer-Tropsch wax; hydrocarbon wax oxides such as polyethylene oxide wax, and block copolymers of these; waxes such as carnauba wax consisting primarily of fatty acid esters; and partially or wholly deoxidized fatty acid esters such as deoxidized carnauba wax.

Other examples include the following: saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters of fatty acids such as palmitic acid, stearic acid, behenic acid and montanic acid with alcohols such as stearyl alcohol, aralkyl alcohol, behenyl alcohol, carnaubyl alcohol, ceryl alcohol and melissyl alcohol; fatty acid amides such as linoleamide, oleamide and lauramide; saturated fatty acid bisamides such as methylene bisstearamide, ethylene biscaproamide, ethylene bislauramide and hexamethylene bisstearamide; unsaturated fatty acid amides such as ethylene bisoleamide, hexamethylene bisoleamide, N,N'-dioleyladipamide and N,N'-dioleylsebacamide; aromatic bisamides such as m-xylene bisstearamide and N,N'-distearyl isophthalamide; aliphatic metal salts (commonly called metal soaps) such as calcium stearate, calcium laurate, zinc stearate and magnesium stearate; waxes obtained by grafting aliphatic hydrocarbon waxes with vinyl monomers such as styrene and acrylic acid; partial esterified products of fatty acids and polyhydric alcohols, such as behenyl acid monoglyceride; and hydroxyl group-containing methyl ester compounds obtained by hydrogenation of plant-based oils and fats.

Of these waxes, a hydrocarbon wax such as paraffin wax and Fischer-Tropsch wax, and a fatty acid ester wax such as carnauba wax are preferred from the standpoint of improving low-temperature fixability and hot offset resistance.

The content of the wax is preferably in the range of from 1 mass parts to 20 mass parts per 100 mass parts of the binder resin.

<Charge Control Agent>

The toner may also contain a charge control agent as necessary. The charge control agent contained in the toner may be a known charge control agent, and metal compounds of aromatic carboxylic acids are particularly desirable because they are colorless, provide rapid charging speeds and can stably maintain a fixed charge quantity.

Examples of negative charge control agents include salicylic acid metal compounds, naphthoic acid metal compounds, dicarboxylic acid metal compounds, polymeric compounds having sulfonic acids or carboxylic acids in the side chains, polymeric compounds having sulfonic acid salts or sulfonic acid esters in the side chains, polymeric compounds having carboxylic acid salts or carboxylic acid esters in the side chains, and boron compounds, urea compounds, silicon compounds and calixarenes.

Examples of positive charge control agents include quaternary ammonium salts, polymeric compounds having such quaternary ammonium salts in the side chains, guanidine compounds, and imidazole compounds.

The charge control agent may be added either internally or externally to the toner particle. The added amount of the charge control agent is preferably in the range of from 0.2 mass parts to 10 mass parts per 100 mass parts of the binder resin.

<Inorganic Fine Particles (Mainly External Additives)>

An inorganic fine particle other than the calcium titanate particle may also be included in the toner as necessary. The inorganic fine particle may be internally added to the toner particle or mixed with the toner particle as an external additive. An inorganic fine powder of silica, titanium oxide, aluminum oxide or the like is preferred as an external additive. The inorganic fine powder is preferably hydrophobized with a hydrophobic agent such as a silane compound or silicone oil or a mixture of these.

An inorganic fine powder with a specific surface area of from 50 $m^2/g$ to 400 $m^2/g$ is preferred as an external additive for improving flowability, while an inorganic fine powder with a specific surface area of from 10 $m^2/g$ to 50 $m^2/g$ is preferred for stabilizing durability. To both improve flowability and stabilize durability, inorganic fine powders with specific surface areas within these ranges may be used together.

The external additive is preferably used in the amount of from 0.1 mass parts to 10.0 mass parts per 100 mass parts of the toner particle. Mixing of the external additive with the toner particle can be accomplished using a known mixer such as a HENSCHEL MIXER.

<Toner Manufacturing Method>

The toner manufacturing method is not particularly limited, and a known method such as an emulsion aggregation method, pulverization method or suspension polymerization method may be used. In emulsion aggregation methods, a toner particle is obtained by preparing a fine particle dispersion comprising the materials of the toner particle, aggregating the fine particle dispersion to form aggregate particles, and melting and fusing the aggregate particles.

The toner manufacturing procedures are explained below using an example of a pulverization method.

In the raw material mixing step, for example, a binder resin, a calcium titanate particle, and other components such as a release agent, charge control agent and the like if necessary as materials constituting the toner particle are weighed, compounded and mixed in specific amounts. The mixing apparatus can be exemplified by the double-cone mixer, V-mixer, drum mixer, Supermixer, HENSCHEL MIXER, Nauta mixer, Mechano Hybrid (Nippon Coke & Engineering Co., Ltd.), and so forth.

The mixed material is then melt-kneaded. The melt-kneading step can use a batch kneader such as a pressure kneader or a Banbury mixer or can use a continuous kneader. Single-screw and twin-screw extruders are preferable for the advantage they offer of enabling continuous production. Examples in this regard are the KTK twin-screw extruder (Kobe Steel, Ltd.), TEM twin-screw extruder (Toshiba Machine Co., Ltd.), PCM kneader (Ikegai Corp.), Twin Screw Extruder (KCK), Co-Kneader (Buss), and Kneadex (Nippon Coke & Engineering Co., Ltd.).

The resin composition yielded by melt-kneading may be rolled using, for example, a two-roll mill, and may be cooled in a cooling step using, for example, water.

The cooled resin composition is then pulverized in a pulverization step to a desired particle diameter. In the pulverization step, for example, a coarse pulverization is performed using a grinder such as a crusher, hammer mill, or feather mill, followed by a fine pulverization using, for example, a pulverizer such as a Kryptron System (Kawasaki Heavy Industries, Ltd.), Super Rotor (Nisshin Engineering Inc.), or Turbo Mill (Turbo Kogyo Co., Ltd.) or using an air jet system.

The classified product (toner particle) is then obtained as necessary by carrying out classification using a sieving apparatus or a classifier, e.g., an inertial classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

The resulting toner particle may be used as is as the toner. The surface of the toner particle may also be externally treated as necessary with an external additive. As a method of externally treating an external additive, predetermined amount of a classified toner particle and various known external additives are blended, and stirring and mixing is performed using a mixing device such as a double-cone mixer, a V-type mixer, a drum mixer, a SUPER mixer, a HENSCHEL MIXER, a NAUTA mixer, a MECHANOHYBRID (manufactured by Nippon Coke Industry Co., Ltd.) or NOBILTA (manufactured by Hosokawa Micron Corporation) as an external addition device.

<Measuring Acid Value of Resin>

The acid value is the number of mg of potassium hydroxide needed to neutralize acid components such as free fatty acids and resin acids contained in 1 g of sample. Measurement is performed in accordance with the methods of JIS K 0070.

(1) Sample

Solvent: A toluene-ethyl alcohol (2:1) mixture is neutralized immediately before use with 0.1 mol/l of potassium hydroxide ethyl alcohol solution using a phenolphthalein indicator.

Phenolphthalein solution: 1 g of phenolphthalein dissolved in 100 ml of ethyl alcohol (95 vol %).

0.1 mol/l potassium hydroxide ethyl alcohol solution: 7.0 g of potassium hydroxide is dissolved in the smallest possible amount of water, ethyl alcohol (95 vol %) is added to a total of 1 liter, and the mixture is left for 2 to 3 days and filtered. Standardization is performed in accordance with JIS K 8006 (Basics of Titration During Reagent Content Testing).

(2) Operations 1 to 20 g of resin is weighed accurately as a sample, 100 ml of the above solvent and several drops of the above phenolphthalein solution as an indicator are added, and the mixture is shaken thoroughly until the sample is completely dissolved. In the case of a solid sample, it is dissolved with heating on a water bath. After cooling, this is titrated with the previous 0.1 mol/l potassium hydroxide ethyl alcohol solution, and the point at which the light pink color of the indicator persists for 30 seconds is taken as the neutralization end point.

(3) Formula

The acid value is calculated by the following formula:

$$A=B\times f\times 5.611/S$$

A: Acid value (mg KOH/g)

B: Amount of 0.1 mol/l potassium hydroxide ethyl alcohol solution used (ml)

f: Factor of 0.1 mol/l potassium hydroxide ethyl alcohol solution

S: Mass of sample (g)

(When Measuring from Toner)

First, the external additive is removed from the toner by the following methods.

160 g of sucrose (Kishida Chemical Co., Ltd.) is added to 100 ml of ion exchange water and dissolved with boiling to prepare a concentrated sucrose solution.

31 g of the concentrated sucrose solution and 6 ml of Contaminon N (a 10 mass % aqueous solution of a pH 7 neutral detergent for cleaning precision measuring instruments, comprising a nonionic surfactant, an anionic surfactant and an organic builder, manufactured by Wako Pure Chemical Industries, Ltd.) are placed in a centrifuge tube to prepare a dispersion.

1.0 g of the toner is added to this dispersion, and toner clumps are broken up with a spatula or the like.

The centrifuge tube is then shaken in a shaker. After being shaken, the solution is transferred to a glass tube (50 ml) for a swing rotor and separated for 30 minutes in a centrifuge at 3500 rpm. An external additive that has been removed from the toner particle is separated by this operation.

Thorough separation of the toner particle and aqueous solution is visually confirmed, and the toner particle is collected and filtered with a vacuum filter, and then dried for at least one hour in a drier to obtain a toner particle from which the external additive has been separated.

The resulting toner particle is further dissolved in tetrahydrofuran, insoluble matters are filtered out, and the dry matter is obtained to separate the binder resin. The acid value of the resin is then measured by the methods described above.

<Structural Determination of Resin>

The following methods are used to determine the structure of the resin.

$^{1}$H-NMR and $^{13}$C-NMR spectrum measurement is performed using a JEOL Ltd. ECA-400 (400 MHz).

Measurement is performed at 25° C. in a deuterated solvent containing tetramethyl silane as an internal standard substance. The chemical shift value is shown as a ppm shift value (δ value) given 0 as the value of the tetramethyl silane used as an internal standard substance.

<Methods for Measuring Weight-Average Molecular Weight and Molecular Weight Distribution of Resin>

The weight-average molecular weights and molecular weight distributions of the binder resin and other resins are measured as follows by gel permeation chromatography (GPC).

The sample is first dissolved in tetrahydrofuran (THF) over the course of 24 hours at room temperature. The resulting solution is then filtered with a solvent-resistant membrane filter (Maishori Disk, Tosoh Corporation) having a pore diameter of 0.2 μm to obtain a sample solution. The concentration of THF-soluble matters in the sample solution is adjusted to approximately 0.8 mass %. Measurement is performed under the following conditions using this sample solution.

Unit: HLC8120 GPC (detector:RI) (Tosoh Corporation)
Columns: Shodex KF-801, 802, 803, 804, 805, 806, 807 (total 7) (Showa Denko K.K.)
Eluent: Tetrahydrofuran (THF)
Flow rate: 1.0 ml/min
Oven temperature: 40.0° C.
Sample injection volume: 0.10 ml A molecular weight calibration curve prepared using standard polystyrene resin (TSK Standard Polystyrene F-850, F-450, F-288, F-128, F-80, F-40, F-20, F-10, F-4, F-2, F-1, A-5000, A-2500, A-1000, A-500, Tosoh Corporation) is used for calculating the molecular weights of the samples.

When measuring from the toner, measurement can be performed after the binder resin has been separated from the toner by the methods described above.

<Content of Calcium Titanate Particle>

The amount of the calcium titanate particle contained in the toner particle is calculated as follows.

For the measurement equipment, an Axios wavelength dispersive X-ray fluorescence spectrometer (Malvern PANalytical Ltd) is used together with the attached dedicated SuperQ ver. 4.0F software (Malvern PANalytical Ltd) for setting the measurement conditions and analyzing the measurement data. Rh is used for the anode of the X-ray tube and vacuum as the measurement atmosphere, with a measurement diameter (collimator mask diameter) of 27 mm and a measurement time of 10 seconds. Detection is performed using a proportional counter (PC) is used for measuring light elements, and a scintillation counter (SC) for measuring heavy elements.

For the measurement sample, 4 g of toner is placed in a dedicated aluminum ring for pressing, spread flat, and pressed for 60 seconds at 20 MPa with a BRE-32 tablet press (Maekawa Testing Machine MFG. Co., Ltd.) to mold a pellet about 2 mm thick and about 39 mm in diameter.

Measurement is performed under the above conditions, the elements are identified based on their peak positions in the resulting X-ray, and their concentrations are calculated from the count rate (unit: cps), which is the number of X-ray photons per unit time.

<Surface Base Amount of Calcium Titanate Particle>

The surface base amount of the calcium titanate particle is calculated as follows.

Calcium titanate is added to a 1/100 mol/l of hydrochloric acid-ethanol solution, treated with ultrasound for 1 hour at 25° C., and centrifuged to obtain a supernatant. Using an AT-510 automatic potentiometric titrator (Kyoto Electronics Manufacturing Co., Ltd.), the supernatant is then subjected to potentiometric titration with a 1/100 mol/l of potassium hydroxide-ethanol solution. The surface base amount of the calcium titanate particle is determined from the difference between the amount of potassium hydroxide used to titrate only a 1/100 mol/l of hydrochloric acid-ethanol solution and the amount of potassium hydroxide used to titrate the supernatant.

(When Measuring from Toner)

The external additive is first separated from the toner particle.

160 g of sucrose (Kishida Chemical Co., Ltd.) is added to 100 ml of ion exchange water and dissolved with boiling to prepare a concentrated sucrose solution.

31 g of the concentrated sucrose solution and 6 ml of Contaminon N (a 10 mass % aqueous solution of a pH 7 neutral detergent for cleaning precision measuring instruments, comprising a nonionic surfactant, an anionic surfactant and an organic builder, manufactured by Wako Pure Chemical Industries, Ltd.) are then placed in a centrifuge tube to prepare a dispersion.

1.0 g of the toner is added to this dispersion, and toner clumps are broken up with a spatula or the like.

The centrifuge tube is then shaken in a shaker. After being shaken, the solution is transferred to a glass tube (50 ml) for a swing rotor and separated for 30 minutes at 3,500 rpm in a centrifuge. An external additive that has been removed from the toner particle is separated by this operation.

Thorough separation of the toner particle and aqueous solution is visually confirmed, and the toner particle is collected and filtered with a vacuum filter, and then dried for at least one hour in a drier to obtain a toner particle from which the external additive has been separated.

Soluble matter other than the calcium titanate particle in the resulting toner particle is then dissolved with tetrahydrofuran, toluene, hexane and the like. This is then filtered and re-dispersed in water, residual external additive is removed by centrifugation to collect the calcium titanate, and the surface base amount is calculated by the surface base amount measurement methods described above.

<Measuring Average Dispersion Diameter of Calcium Titanate Particle by TEM Observation>

The average dispersion diameter of the calcium titanate particle in the toner particle is measured as follows by transmission electron microscopy (TEM).

An Osmium Plasma Coater (Filgen, Inc., OPC80T) is used to form an Os film (5 nm) and a naphthalene film (20 nm) as protective films on the toner, which is then enveloped in D800 photocurable resin (JEOL Ltd.). 60 nm-thick toner particle cross-sections are then prepared at a cutting speed of 1 mm/s with an ultrasonic ultramicrotome (Leica Microsystems, UC7).

The circle equivalent diameters of the measurable calcium titanate particles in 20 randomly selected toner particle cross-sections are measured, and the arithmetic mean is given as the average dispersion diameter of the calcium titanate particle in the toner particle.

EXAMPLES

Examples and comparative examples of the present invention are explained in detail below, but these examples do not limit the invention. In the formulations below, parts are based on mass unless otherwise specified.

Example 1

Binder resin 1: 100 parts (Polyester resin, composed of polyoxypropylene(2.2)-2,2-bis(4-hydroxyphenyl)

propane:polyoxyethylene(2.2)-2,2-bis(4-hydroxyphenyl) propane:terephthalic acid:dodecylsuccinic acid:trimellitic acid=80:20:75:10:15 (mol %), Mw=152000, amount of components of molecular weight of from 100 to 5000=25 mass %, acid value=12 mg KOH/g)

Calcium titanate (KCM Corporation, surface base amount 24 μmol/g, average particle diameter 600 nm): 86 parts Fischer-Tropsch wax (maximum endothermic peak temperature 78° C.): 5 parts 3,5-di-t-butyl salicylic acid aluminum compound (Orient Chemical Industries, Co., Ltd., Bontron E88): 0.5 parts These materials were mixed for 5 minutes at a rotation of 20 $s^{-1}$ with a HENSCHEL MIXER (FM-75, Mitsui Mining), and then kneaded at 200 rpm with a two-axis extruder (Ikegai Corporation PCM-30) set to 140° C. The kneaded product was cooled to 25° C., and coarsely ground to 1 mm or less in a hammer mill to obtain a coarsely ground product.

The coarsely ground product was finely pulverized with a mechanical crusher (T-250, Freund Turbo Corporation). This was then classified with a Faculty F-300 (Hosokawa Micron Corporation) to obtain a toner particle 1. The calcium titanate used here had a perovskite crystal structure.

Example 2

(Preparation of Resin Fine Particle Dispersion 1)

Tetrahydrofuran (Wako Pure Chemical, Ltd.): 1000 parts

Binder resin 1: 600 parts

Anionic surfactant (Neogen RK, Daiichi Kogyo): 3 parts

These were mixed and stirred for 12 hours to dissolve the resin. 13.5 parts of N,N-dimethyl aminoethanol were then added, and the mixture was stirred at 5000 rpm with a homogenizer (IKA Works GmbH & Co. KG, Ultra-turrax T50). 1800 parts of ion exchange water were then added, and a resin fine particle was precipitated. The tetrahydrofuran was then removed with an evaporator to obtain a resin fine particle dispersion 1.

(Preparation of Calcium Titanate Particle Dispersion 1)

Calcium titanate (KCM Corporation, surface base amount 24 μmol/g, average particle diameter 600 nm): 100 parts Anionic surfactant (Neogen RK, DKS Co., Ltd.): 5 parts Ion exchange water: 895 parts These were mixed and stirred at 5000 rpm with a homogenizer (IKA Works GmbH & Co. KG, Ultra-turrax T50) to prepare a calcium titanate particle dispersion 1. The calcium titanate used here had a perovskite crystal structure.

(Preparation of Release Agent Fine Particle Dispersion 1)

| | |
|---|---|
| Fischer-Tropsch Wax (maximum endothermic peak temperature 78° C.) | 200 parts |
| Anionic surfactant (Neogen RK, DKS Co., Ltd.) | 10 parts |
| Ion exchange water | 790 parts |

These were placed in a mixing container with an attached stirrer, heated to 90° C., and circulated into a Clearmix W-Motion (M Technique Co., Ltd.) while being dispersed for 60 minutes by stirring at a rotor speed of 19000 rpm and a screen rotation of 19000 rpm in a shear agitation site with an external rotor diameter of 3 cm and a clearance of 0.3 mm. This was then cooled to 40° C. at a rotor speed of 1000 rpm, a screen rotation of 0 rpm and a cooling speed of 10° C./min to obtain a release agent fine particle dispersion 1.

Resin fine particle dispersion 1: 3000 parts

Calcium titanate particle dispersion 1: 8000 parts

Release agent fine particle dispersion 1: 225 parts

These materials were placed in a round-bottomed stainless-steel flask, and 300 parts of a 10% magnesium sulfate aqueous solution were added. This was then dispersed for 10 minutes at 5000 rpm with a homogenizer (IKA Works GmbH & Co. KG, Ultra-Turrax T50). This was then heated to 55° C. with a stirring blade in a heating water bath, with the rotation adjusted appropriately so that the mixture was stirred. This was then maintained at 55° C. for 20 minutes, and a Beckman Coulter, Inc. Multisizer III was used to confirm that aggregate particles had been formed with a volume-average particle diameter of about 6.0 μm.

2000 parts of a 5 mass % sodium ethylenediamine tetraacetate aqueous solution were added to this aggregate particle dispersion, and stirring was continued as the mixture was heated to 95° C., maintained for 1 hour and then cooled. The resulting aggregate particle dispersion was then filtered and subjected to solid-liquid separation, and the filtrate was washed with ion exchange water. After completion of washing this was dried with a vacuum drier to obtain a toner particle 2.

Example 3

A toner particle 3 was obtained as in the manufacturing example of the toner particle 1 except that the amount of the calcium titanate was changed to 156 parts.

Example 4

A toner particle 4 was obtained as in the manufacturing example of the toner particle 1 except that kneading was performed with the rotational speed of the two-axis extruder changed to 300 rpm.

Example 5

A toner particle 5 was obtained as in the manufacturing example of the toner particle 1 except that kneading was performed with the rotational speed of the two-axis extruder changed to 100 rpm.

Example 6

A toner particle 6 was obtained as in the manufacturing example of the toner particle 5 except that the binder resin 1 was replaced with a binder resin 2 (composition (mol %) of polyoxypropylene(2.2)-2,2-bis(4-hydroxyphenyl) propane:polyoxyethylene(2.2)-2,2-bis(4-hydroxyphenyl) propane:terephthalic acid:fumaric acid:trimellitic acid=80:20:35:55:10, Mw=120000, amount of components of molecular weight of from 100 to 5000=16 mass %, acid value=15 mg KOH/g).

Example 7

A toner particle 7 was obtained as in the manufacturing example of the toner particle 5 except that the binder resin 1 was replaced with a binder resin 3 (composition (mol %) of polyoxypropylene(2.2)-2,2-bis(4-hydroxyphenyl) propane:polyoxyethylene(2.2)-2,2-bis(4-hydroxyphenyl) propane:fumaric acid:dodecylsuccinic acid:trimellitic acid=77:23:65:5:30, Mw=70000, amount of components of molecular weight of from 100 to 5000=48 mass %, acid value=22 mg KOH/g).

Example 8

A toner particle 8 was obtained as in the manufacturing example of the toner particle 5 except that the binder resin 1 was replaced with a binder resin 4 (composition (mol %) of polyoxypropylene(2.2)-2,2-bis(4-hydroxyphenyl) propane:polyoxyethylene(2.2)-2,2-bis(4-hydroxyphenyl) propane: fumaric acid:trimellitic acid=74:26:95:5, Mw=40000, amount of components of molecular weight of from 100 to 5000=18 mass %, acid value=25 mg KOH/g).

Example 9

A toner particle 9 was obtained as in the manufacturing example of the toner particle 8 except that the rotational speed of the twin axis extruder was changed to 250 rpm.

Example 10

A toner particle 10 was obtained as in the manufacturing example of the toner particle 5 except that the binder resin 1 was replaced with a binder resin 5 (composition (mol %) of polyoxypropylene(2.2)-2,2-bis(4-hydroxyphenyl) propane:polyoxyethylene(2.2)-2,2-bis(4-hydroxyphenyl) propane:fumaric acid:trimellitic acid=75:25:80:20, Mw=220000, amount of components of molecular weight of from 100 to 5000=15 mass %, acid value=12 mg KOH/g).

Example 11

A toner particle 11 was obtained as in the manufacturing example of the toner particle 10 except that a 10 mass % ethanol solution of calcium titanate was mixed with a 10 mass % ethanol solution of trimethoxysilane, the temperature was raised to 80° C., the mixture was reacted for 1 hour, and this was then filtered and washed with ethanol, thereby changing the surface base amount to 17 μmol/g. The calcium titanate used here had a perovskite crystal structure.

Example 12

A toner particle 12 was obtained as in the manufacturing example of the toner particle 10 except that a 10 mass % ethanol solution of calcium titanate was mixed with a 20 mass % ethanol solution of trimethoxysilane, the temperature was raised to 80° C., the mixture was reacted for 2 hours, and this was then filtered and washed with ethanol, thereby changing the surface base amount to 11 μmol/g. The calcium titanate used here had a perovskite crystal structure.

Example 13

A toner particle 13 was obtained as in the manufacturing example of the toner particle 12 except that the binder resin 5 was replaced with a binder resin 6 (composition (mol %) of polyoxypropylene(2.2)-2,2-bis(4-hydroxyphenyl) propane:terephthalic acid:trimellitic acid=100:90:10 (mol %), Mw=230000, amount of components of molecular weight of from 100 to 5000=14 mass %, acid value=8 mg KOH/g).

Example 14

A toner particle 14 was obtained as in the manufacturing example of the toner particle 12 except that the binder resin 5 was replaced with a binder resin 7 (composition (mol %) of polyoxypropylene(2.2)-2,2-bis(4-hydroxyphenyl) propane:polyoxyethylene(2.2)-2,2-bis(4-hydroxyphenyl) propane:terephthalic acid:dodecylsuccinic acid:trimellitic acid=80:20:70:5:25, Mw=210000, amount of components of molecular weight of from 100 to 5000=16 mass %, acid value=38 mg KOH/g).

Example 15

A toner particle 15 was obtained as in the manufacturing example of the toner particle 12 except that the binder resin 5 was replaced with a binder resin 8 (styrene-acrylic resin, styrene: n-butyl acrylate:acrylic acid=71:28:1, Mw=22000, amount of components of molecular weight of from 100 to 5000=35 mass %, acid value=12 mg KOH/g).

Example 16

A toner particle 16 was obtained as in the manufacturing example of the toner particle 14 except that the amount of calcium titanate was changed to 45 parts.

Example 17

A toner particle 17 was obtained as in the manufacturing example of the toner particle 14 except that the amount of calcium titanate was changed to 250 parts.

Comparative Example 1

A toner particle 18 was obtained as in the manufacturing example of the toner particle 1 except that the amount of calcium titanate was changed to 25 parts.

Comparative Example 2

A toner particle 19 was obtained as in the manufacturing example of the toner particle 1 except that the amount of calcium titanate was changed to 450 parts.

Comparative Example 3

A toner particle 20 was obtained as in the manufacturing example of the toner particle 1 except that titanium oxide (Ishihara Sangyo Kaisha, Ltd., PF-739) was substituted for the calcium titanate.

1.8 parts of a silica fine powder with a BET specific surface area of 200 $m^2/g$ that had been hydrophobically treated with silicone oil were dry mixed in a Henschel mixer with 100 parts of each of the toner particles 1 to 20 to prepare toners 1 to 20 each having an external additive. The physical properties of the resulting toners are shown in Table 1.

TABLE 1

| | | White pigment | | | | Binder resin | | | |
|---|---|---|---|---|---|---|---|---|---|
| Example No. | Toner No. | White pigment type | Content (mass %) | Surface base amount (μmol/g) | Average dispersion diameter (nm) | No. | Acid value (mg KOH/g) | Weight-average molecular weight | Low-molecular-weight components (mass %) |
| 1 | 1 | Calcium litanate | 45 | 24 | 400 | 1 | 12 | 152000 | 25 |
| 2 | 2 | Calcium litanate | 45 | 24 | 450 | 1 | 12 | 152000 | 25 |
| 3 | 3 | Calcium litanate | 60 | 24 | 420 | 1 | 12 | 152000 | 25 |
| 4 | 4 | Calcium litanate | 45 | 24 | 150 | 1 | 12 | 152000 | 25 |
| 5 | 5 | Calcium litanate | 45 | 24 | 550 | 1 | 12 | 152000 | 25 |
| 6 | 6 | Calcium litanate | 45 | 24 | 520 | 2 | 15 | 120000 | 16 |
| 7 | 7 | Calcium litanate | 45 | 24 | 550 | 3 | 22 | 70000 | 48 |
| 8 | 8 | Calcium litanate | 45 | 24 | 500 | 4 | 25 | 40000 | 18 |
| 9 | 9 | Calcium litanate | 45 | 24 | 290 | 4 | 25 | 40000 | 18 |
| 10 | 10 | Calcium litanate | 45 | 24 | 540 | 5 | 12 | 220000 | 15 |
| 11 | 11 | Calcium litanate | 45 | 17 | 540 | 5 | 12 | 220000 | 15 |
| 12 | 12 | Calcium litanate | 45 | 11 | 520 | 5 | 12 | 220000 | 15 |
| 13 | 13 | Calcium litanate | 45 | 11 | 500 | 6 | 8 | 230000 | 14 |
| 14 | 14 | Calcium litanate | 45 | 11 | 520 | 7 | 38 | 210000 | 16 |
| 15 | 15 | Calcium litanate | 45 | 11 | 510 | 8 | 12 | 22000 | 35 |
| 16 | 16 | Calcium litanate | 30 | 11 | 520 | 7 | 38 | 210000 | 16 |
| 17 | 17 | Calcium litanate | 70 | 11 | 510 | 7 | 38 | 210000 | 16 |
| Comparative 1 | 18 | Calcium litanate | 20 | 24 | 400 | 1 | 12 | 152000 | 25 |
| Comparative 2 | 19 | Calcium litanate | 85 | 24 | 420 | 1 | 12 | 152000 | 25 |
| Comparative 3 | 20 | Titanium oxide | 45 | 28 | 300 | 1 | 12 | 152000 | 25 |

In the table, "low-molecular-weight components" indicates the content of components with a molecular weight of from 100 to 5000 in the THF-soluble matter of the binder resin.

(Toner Evaluation)

<Evaluating Concealing Properties>

Each of the toners obtained above was mixed to a toner concentration of 8 mass % with a ferrite carrier (average particle diameter 42 μm) that had been surface coated with silicone resin, to prepare two-component developers.

The obtained two-component developer was loaded in a commercially available full-color digital copying machine (CLC1100, manufactured by Canon Inc.), and an unfixed toner image (toner laid-on level: 1.0 mg/cm$^2$) was formed on black paper having an image density of 1.3 or more. The unfixed image was fixed using a fixing unit detached from a commercially available full-color digital copying machine (image RUNNER ADVANCE C5051, manufactured by Canon Inc.). The image density of the obtained fixed image was measured using an X-Rite color reflection densitometer (500 series: manufactured by X-Rite). The image density at this time was evaluated according to the following standard. A rank of C or more is considered good. The evaluation results are shown in Table 2.

(Evaluation Standard)

A: Less than 0.30

B: At least 0.30 and less than 0.35

C: At least 0.35 and less than 0.40

D: At least 0.40 and less than 0.45

E: At least 0.45

<Evaluating Hot Offset Resistance>

An unfixed image for evaluation (toner laid-on level 0.6 mg/cm$^2$) was prepared using a full color digital copier (CLC1100, Canon Inc.). The fixing unit was then removed from a commercial full color digital copier (image RUNNER ADVANCE C5051, Canon Inc.) and modified to allow the fixing temperature to be adjusted, and a fixing test of the unfixed image was performed using this fixing unit.

The reflectance of the evaluation paper before image output was measured with a reflectometer (Reflectometer Model TC-6DS, Tokyo Denshoku Co., Ltd.), and the average measured value from 5 locations was given as the DA (%). The fixing temperature of the fixing unit was varied, the reflectance of the part without a formed image was measured with the reflectometer at each fixing temperature, and the maximum value was given as the DB (%), The highest fixing temperature at which the difference between DA (%) and DB (%) did not exceed 0.5% was given as the maximum fixing temperature. Hot offset resistance was then evaluated according to the following standard based on the maximum fixing temperature. A rank of C or more was considered good. The evaluation results are shown in Table 2.

(Evaluation Standard)

A: At least 200° C.

B: At least 190° C. and less than 200° C.

C: At least 180° C. and less than 190° C.

D: At least 170° C. and less than 180° C.

E: Less than 170° C.

<Charging Performance Evaluation>

0.01 g of toner was weighed into an aluminum pan and charged to −600 V with a scorotron charging device. The change behavior of surface potential was then measured for 30 minutes with a surface potential meter (Trek Japan KK, Model 347) in an environment of 25° C., 50% RH. The measurement results were substituted into the following formula to calculate the charge retention rate, which was evaluated according to the following standard. A rank of B or more is considered good. The evaluation results are shown in Table 2.

Charge retention rate (%) after 30 minutes=[Surface potential after 30 minutes]/[Initial surface potential]×100 Formula:

(Evaluation Standard)

A: Charge retention rate after 30 minutes was at least 90%

B: Charge retention rate after 30 minutes was at least 50% and less than 90%

C: Charge retention rate after 30 minutes was less than 50%

TABLE 2

| | | Concealing property | Hot offset resistance | Charging performance |
|---|---|---|---|---|
| Example 1 | Toner 1 | A | A | A |
| Example 2 | Toner 2 | A | A | A |
| Example 3 | Toner 3 | A | A | A |
| Example 4 | Toner 4 | B | B | A |
| Example 5 | Toner 5 | B | B | A |
| Example 6 | Toner 6 | B | B | A |
| Example 7 | Toner 7 | B | C | A |
| Example 8 | Toner 8 | B | C | A |
| Example 9 | Toner 9 | B | C | A |
| Example 10 | Toner 10 | C | B | A |
| Example 11 | Toner 11 | C | C | A |
| Example 12 | Toner 12 | C | C | A |
| Example 13 | Toner 13 | C | C | A |
| Example 14 | Toner 14 | C | A | B |
| Example 15 | Toner 15 | C | C | A |
| Example 16 | Toner 16 | C | C | B |
| Example 17 | Toner 17 | A | C | B |
| Comparative Example 1 | Toner 18 | E | B | A |
| Comparative Example 2 | Toner 19 | A | C | C |
| Comparative Example 3 | Toner 20 | A | D | B |

According to the present invention, white toner that has excellent concealing properties without a reduction in hot offset resistance can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A white toner comprising a toner particle wherein the toner particle includes a binder resin and a calcium titanate particle, the binder resin has an acid value, and a content of the calcium titanate particle in the toner is in the range of from 25 mass % to 80 mass %.

2. The white toner according to claim 1, wherein the acid value of the binder resin is in the range of from 10 mg KOH/g to 30 mg KOH/g.

3. The white toner according to claim 1, wherein the calcium titanate particle has a surface base amount in the range of at least 15 μmol/g.

4. The white toner according to claim 1, wherein a weight-average molecular weight of tetrahydrofuran-soluble matters of the binder resin as measured by gel permeation chromatography is in the range of from 50,000 to 200,000.

5. The white toner according to claim 1, wherein a content of components with a molecular weight of from 100 to 5,000 in the molecular weight distribution of tetrahydrofuran-soluble matters of the binder resin as measured by gel permeation chromatography is in the range of from 20 mass % to 40 mass % based on the total amount of the tetrahydrofuran-soluble matter of the binder resin.

6. The white toner according to claim 1, wherein the average dispersion diameter of the calcium titanate particle in the toner particle is in the range of from 200 nm to 500 nm.

7. The white toner according to claim 1, wherein the calcium titanate particle has a perovskite crystal structure.

8. The white toner according to claim 1, wherein the binder resin includes a polyester resin.

* * * * *